United States Patent [19]

Tinnel

[11] 4,015,299

[45] Apr. 5, 1977

[54] WATER BED

[76] Inventor: Robert Tinnel, 3798 Grand Ave., Oakland, Calif. 94610

[22] Filed: Feb. 9, 1976

[21] Appl. No.: 656,605

[52] U.S. Cl. ..... 5/370; 5/334 C

[51] Int. Cl.[2] ..... A47C 27/08

[58] Field of Search ..... 5/336, 334 C, 335, 367, 5/370, 371

[56] References Cited

UNITED STATES PATENTS

| | | | |
|---|---|---|---|
| 2,481,833 | 9/1949 | Foster | 5/370 X |
| 3,066,321 | 12/1962 | Kintner | 5/334 C X |
| 3,702,484 | 11/1972 | Tobinick | 5/370 |
| 3,736,604 | 6/1973 | Carson | 5/370 |
| 3,742,531 | 7/1973 | Alsbury | 5/370 |

*Primary Examiner*—Paul R. Gilliam
*Assistant Examiner*—Andrew M. Calvert
*Attorney, Agent, or Firm*—Harris Zimmerman

[57] ABSTRACT

A water bed construction includes a box foundation on which rests an upwardly opening rectangular coffer formed by a polyurethane sheet and a polyurethane perimetrical member disposed thereon. The coffer cavity receives and contains a shallow water mattress, and a foam pad is disposed over the mattress. The foam construction obviates the need for a mattress heater, and serves to attenuate resonant frequency phenomena of the mattress. The foam perimeter also permits the use of standard fitted sheets.

2 Claims, 3 Drawing Figures

WATER BED

BACKGROUND OF THE INVENTION

Although water beds of various constructions have become extremely popular in recent years, many individuals have purchased water beds and have been dissatisfied with them. The water mattress, which is basically a non-form retaining bag filled to capacity with water, exhibits a resonant frequency phenomenon related to the size of the bag and the mass of the water. Many individuals find this resonant characteristic disruptive of sleep or other pursuits.

Also, a king size water bed of standard construction may weigh close to 2000 pounds (900 kg.). Many residential buildings are not designed to support this much weight on a relatively small floor space. Therefor water beds have been banned in many places.

Furthermore, a water bed of standard construction generally consists of a coffer or box of wood planking which contains the water bag. It is very uncomfortable to sit on the edge of such a bed, as the bag offers no substantial support over a small cross-sectional area, and the planking, being hard and unyielding, is bruising at best. Also, should one roll to the edge of the water mattress, the water is displaced to the remainder of the mattress and the individual is uncomfortably wedged into the corner of the coffer.

SUMMARY OF THE INVENTION

The present invention generally comprises a water bed construction which minimizes the bed weight characteristic of prior art constructions, and which also tempers the unpleasant resonant wave characteristic of the water mattress. The invention includes a relatively thin water mattress which is supported on a base sheet of polyurethane or similar foam material. The mattress is bordered on all sides by a rectangle of polyurethane foam which forms the perimeter of the bed. The polyurethane sheet rests on a sturdy box foundation.

Extending over the water mattress and the foam border member is a sheet of insulating foam material which serves both as thermal insulation as as a resonance attenuator. The insulating sheet is joined to the underside of the base sheet by a hook and pile fasteners or the like. The bed is adapted to retain standard fitted sheets, which are secured under the corners of the base sheet in a manner similar to that known in the prior art for standard mattresses. The bed construction of the present invention requires no plank sides, is comfortable to sit on, and requires no energy-squandering water heater.

THE DRAWING

DESCRIPTION OF THE PREFERRED EMBODIMENT

Figure 1:
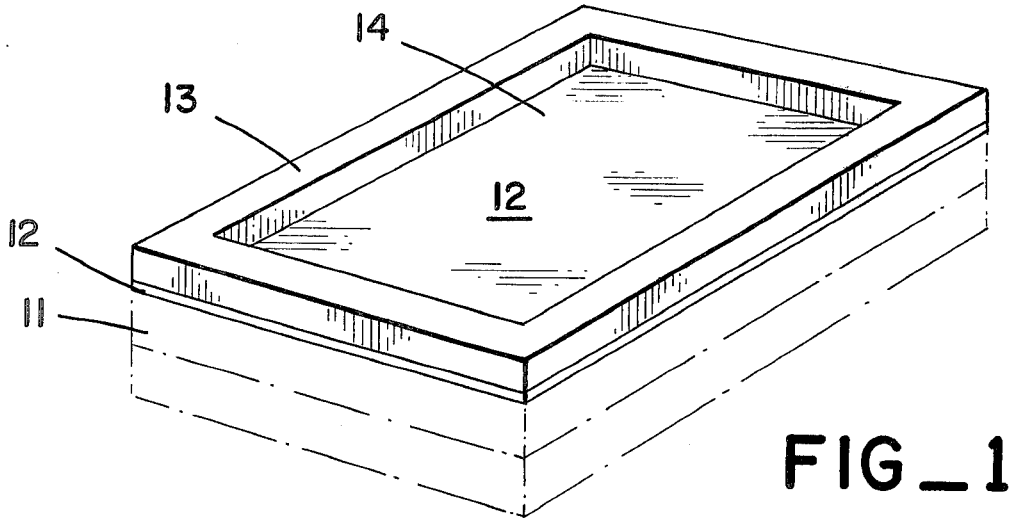
FIG. 1 is a perspective view of the water bed construction of the present invention.

The water bed construction of the present invention generally includes a sturdy, rectangular foundation 11 on which is disposed a rectangular sheet 12 of polyurethane foam or the like. The sheet 12 is similar in length and width to the foundation, and is preferably 1½ to 2 inches (3.8 to 5 km) in thickness. Secured on the base sheet 13 is a rectangular border member 13 formed of high density, high firmness polyurethane foam or the like. The border member is preferably 4½ inches (11.5 cm) high and 6 inches (15cm.) in cross-sectional width. The border member together with the base sheet defines a coffer having an upwardly opening rectangular cavity 14.

Figure 2:
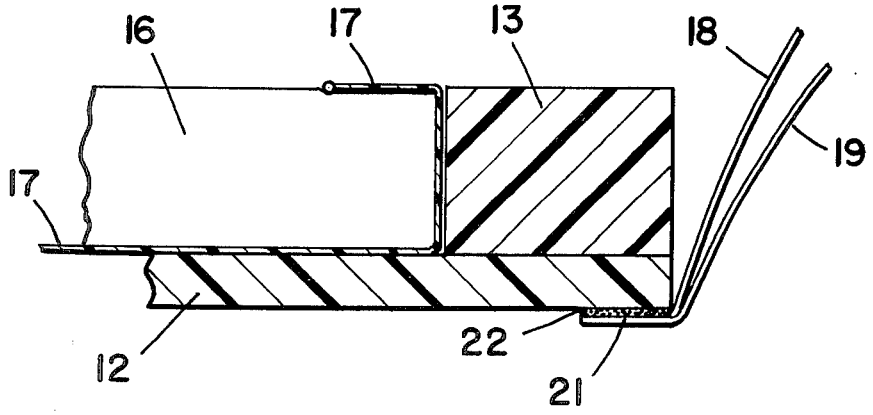
FIG. 2 is a cross-sectional view of a portion of the water bed construction of the present invention.

Received within the cavity 14 is a generally rectangular water mattress 16, which is configured to impinge on the interior surfaces of the border member and be supported thereby. As shown in FIG. 2, the mattress 16 is disposed within a non-form-retaining safety liner of vinyl material or the like which retains any water leaking from the mattress. The mattress is configured so that the top surface thereof is flush with the top surface of the border member 13 when the mattress is fully inflated with water.

Disposed along the perimeter of the lower surface of the base sheet 12 is one confronting portion of a hook and pile fastener 22. The other confronting portion of the hook and pile fastener is secured to the lower edge of a coverlet 24. The coverlet 24 comprises a pair of fabric sheet members 18 and 19 which are joined at their respective lower edges to the hook and pile fastener. Disposed between the members 18 and 19 is a foam pad 23 of polyurethane or the like. The pad 23 is approximately ½ inch (1.25cm) thick, and extends over the entire upper surface of the bed. The pad 23 may be quilted or otherwise secured to the members 18 and 19.

Figure 3:
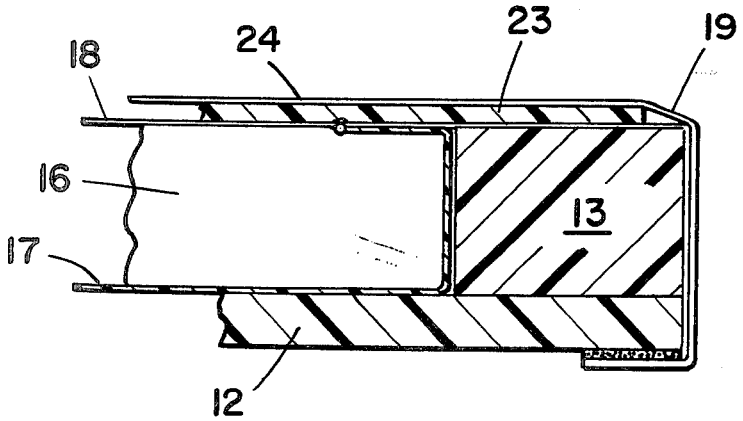
FIG. 3 is a cross-sectional view of a portion of the water bed construction of the present invention.

The members 18 and 19 are configured to extend over the entire top and sides of the bed, and to be fastened to the underside of the base sheet, as shown in FIGS. 2 and 3. The pad 23 is an effective thermal insulator, preventing the loss of body heat to the water in the mattress 16. Thus the bed according to the present invention does not require a heater for maintaining the water in the bed at or near to body temperature. Furthermore, the pad resting on the entire upper surface of the mattress, together with the resiliency of the foam members 12 and 13, act to absorb some of the wave energy of the mattress. In particular, the resonant frequency is attenuated, providing a more restful repose for an individual without diminishing the comfort for which water beds are so well known.

The coverlet 24 also provides the water bed of the present invention with the appearance and convenience of a conventional mattress. The outside dimensions of the members 12 and 13 may be selected in accordance with standard bed sizes, such as single, double, king, queen, etc. The bed construction permits fitted sheets of standard sizes to be secured under the corners of the base sheet 12 in a manner similar to that used with standard mattresses. Standard flat sheets may also be tucked under the base sheet 12.

It should be noted that due to the presence of the foam members 12 and 13, the water mattress 16 is both shallower and narrower than a water mattress of the prior art for the same size bed. This feature results in a substantial weight reduction, and a gain, rather than a loss, in comfort. For example, a king size waterbed according to the present invention weighs approximately 600 pounds (270 kg), complete, as compared to approximately 2000 pounds (900 kg) for a similar water bed of standard construction. Also, it is possible to install two narrow mattresses within the cavity of the coffer 14. One may be a water mattress as described herein, and the other may be a foam or coil mattress. In this way an individual may have the best of both forms of sleeping accommodations, or a couple may exercise their individual sleeping preferences.

I claim:

1. A bed construction comprising a base member formed of a thick sheet of dense foam material, a border member formed of a resilient, dense foam material secured to the periphery of said base member, said border member extending continuously about said periphery and projecting upwardly therefrom, said border member including an interior wall extending generally orthogonally from said base member; said bed construction also including a seating area at the periphery therof, said seating area comprising a broad, laterally extending upper surface of said border member, said base member and sid interior wall of said border member defining an upwardly opening coffer having generally vertical side walls, a water mattress disposed within said coffer, and a resilient, insulating pad extending over said water mattress and said upper surface of said border member.

2. The bed construction of claim 1, further including a coverlet disposed about the top and sides of said bed, said coverlet including a pair of spaced fabric sheets, the portion of said sheets overlying said mattress and said upper surface of said border member being spaced apart and receiving therebetween said resilient pad, and fastener means for securing the peripheral edges of said coverlet to the peripheral undersurface of said base member.

* * * * *